US012565706B2

(12) United States Patent
Litton et al.

(10) Patent No.: US 12,565,706 B2
(45) Date of Patent: Mar. 3, 2026

(54) ENVIRONMENTAL BARRIER COATING AND METHOD OF MAKING THE SAME

(71) Applicant: RTX Corporation, Farmington, CT (US)

(72) Inventors: David A. Litton, West Hartford, CT (US); Brian T. Hazel, Avon, CT (US); Alan C. Barron, Jupiter, FL (US)

(73) Assignee: RTX CORPORATION, Farmington, CT (US)

( * ) Notice: Subject to any disclaimer, the term of this patent is extended or adjusted under 35 U.S.C. 154(b) by 105 days.

(21) Appl. No.: 18/229,338

(22) Filed: Aug. 2, 2023

(65) Prior Publication Data

US 2024/0044011 A1 Feb. 8, 2024

Related U.S. Application Data

(60) Provisional application No. 63/394,453, filed on Aug. 2, 2022.

(51) Int. Cl.

| | |
|---|---|
| ***C23C 28/04*** | (2006.01) |
| ***C23C 4/11*** | (2016.01) |
| ***C23C 4/134*** | (2016.01) |
| *C25D 13/02* | (2006.01) |

(52) U.S. Cl.

CPC ..... *C23C 28/04* (2013.01); *C23C 4/11* (2016.01); *C23C 4/134* (2016.01); *C25D 13/02* (2013.01)

(58) Field of Classification Search

CPC ..... C23C 28/04; C23C 4/11; C23C 4/134

See application file for complete search history.

(56) References Cited

U.S. PATENT DOCUMENTS

| | | | | |
|---|---|---|---|---|
| 6,767,636 | B2 * | 7/2004 | Takai | C23C 4/11 428/328 |
| 8,216,689 | B2 * | 7/2012 | Witz | C23C 4/10 204/192.15 |
| 9,096,763 | B2 | 8/2015 | Belov et al. | |
| 2010/0159150 | A1 * | 6/2010 | Kirby | C04B 41/009 427/419.7 |
| 2015/0147524 | A1 | 5/2015 | Petorak | |
| 2017/0191152 | A1 | 7/2017 | Grossman et al. | |
| 2019/0017177 | A1 | 1/2019 | Gold et al. | |
| 2021/0054492 | A1 | 2/2021 | Torigoe et al. | |

FOREIGN PATENT DOCUMENTS

| | | |
|---|---|---|
| CN | 112939629 | 6/2021 |
| EP | 3418420 | 12/2018 |

OTHER PUBLICATIONS

European Search Report for European Patent Application No. 23188436.2 dated Aug. 29, 2023.

* cited by examiner

*Primary Examiner* — Nathan T Leong

(74) *Attorney, Agent, or Firm* — Carlson, Gasey & Olds, P.C.

(57) ABSTRACT

A method of applying a top coat to an article according to an exemplary embodiment of this disclosure, among other possible things includes applying a first feedstock comprising particles of oxide-based material having diameters between about 1 and about 80 microns via a thermal spray process to form a first top coat layer on an article having a bond coat and applying a second feedstock comprising particles of oxide-based material having diameters between about 15 and about 60 microns via the thermal spray process to form a second top coat layer on the first top coat layer. An article and a barrier layer for an article are also disclosed.

14 Claims, 2 Drawing Sheets

ENVIRONMENTAL BARRIER COATING AND METHOD OF MAKING THE SAME

CROSS-REFERENCE TO RELATED APPLICATIONS

This application claims the benefit of Provisional U.S. Patent Application Ser. No. 63/394,453 filed Aug. 2, 2022; the disclosure of which is incorporated by reference in its entirety herein.

BACKGROUND

A gas turbine engine typically includes a fan section, a compressor section, a combustor section and a turbine section. Air entering the compressor section is compressed and delivered into the combustion section where it is mixed with fuel and ignited to generate a high-energy exhaust gas flow. The high-energy exhaust gas flow expands through the turbine section to drive the compressor and the fan section. The compressor section typically includes low and high pressure compressors, and the turbine section includes low and high pressure turbines.

This disclosure relates to composite articles, such as those used in gas turbine engines, and methods of coating such articles. Components, such as gas turbine engine components, may be subjected to high temperatures, corrosive and oxidative conditions, and elevated stress levels. In order to improve the thermal and/or oxidative stability, the component may include a protective barrier coating.

SUMMARY

A method of applying a top coat to an article according to an exemplary embodiment of this disclosure, among other possible things includes applying a first feedstock comprising particles of oxide-based material having diameters between about 1 and about 80 microns via a thermal spray process to form a first top coat layer on an article having a bond coat and applying a second feedstock comprising particles of oxide-based material having diameters between about 15 and about 60 microns via the thermal spray process to form a second top coat layer on the first top coat layer.

In a further example of the foregoing, the particles of oxide-based material include particles of at least one of hafnia, hafnium silicates, yttrium silicates, ytterbium silicates, other rare earth silicates or combinations of rare earth silicates, calcium aluminosilicates, mullite, barium strontium aluminosilicate, strontium aluminosilicate.

In a further example of any of the foregoing, the thermal spray process is one of air plasma spray, a suspension deposition process, and electrophoretic deposition (EPD).

In a further example of any of the foregoing, the first top coat layer has a higher porosity than the second top coat layer.

In a further example of any of the foregoing, the second top coat layer is performed without moving the article after the step of applying the first top coat layer.

In a further example of any of the foregoing, the method also includes curing or sintering the first and second top coat layers.

In a further example of any of the foregoing, a surface roughness of the second top coat layer is less than about 6 microns (150 microinches).

In a further example of any of the foregoing, the particles in the first feedstock have diameters between about 10 and about 70 microns.

In a further example of any of the foregoing, the particles in the second feedstock have diameters between about 20 and about 50 microns.

In a further example of any of the foregoing, the bond coat comprises gettering particles and diffusive particles disposed in a matrix.

An article according to an exemplary embodiment of this disclosure, among other possible things includes a substrate and a barrier layer on the substrate. The barrier layer includes a bond coat comprising a matrix, diffusive particles disposed in the matrix, and gettering particles disposed in the matrix; and a topcoat comprising a first top coat layer adjacent the bond coat and a second top coat layer disposed on the first top coat layer, the first top coat layer having a lower porosity than the second top coat layer.

In a further example of the foregoing, the first top coat layer has a thickness between about 1.5 and about 2.5 times a thickness of the second top coat layer.

In a further example of any of the foregoing, the first top coat layer is between about 50 and about 250 microns thick and the second top coat layer is between about 25 and about 125 microns thick.

In a further example of any of the foregoing, a porosity of the first top coat layer is between about 10% and about 20% and the porosity of the second top coat layer is between about 5% and about 10%.

In a further example of any of the foregoing, the first and second top coat layers comprise at least one of hafnia, hafnium silicate, yttrium silicate, yttria stabilized zirconia, gadolinia stabilized zirconia, calcium aluminosilicates, mullite, and barium strontium aluminosilicate, or combinations thereof.

A barrier layer for an article according to an exemplary embodiment of this disclosure, among other possible things includes a bond coat comprising a matrix, diffusive particles disposed in the matrix, and gettering particles disposed in the matrix; and a topcoat comprising a first top coat layer adjacent the bond coat and a second top coat layer disposed on the first top coat layer, the first top coat layer having a lower porosity than the second top coat layer.

In a further example of the foregoing, the first top coat layer has a thickness between about 1.5 and about 2.5 times a thickness of the second top coat layer.

In a further example of any of the foregoing, the first top coat layer is between about 50 and about 250 microns thick and the second top coat layer is between about 25 and about 125 microns thick.

In a further example of any of the foregoing, a porosity of the first top coat layer is between about 10% and about 20% and the porosity of the second top coat layer is between about 5% and about 10%.

In a further example of any of the foregoing, the first and second top coat layers comprise at least one of hafnia, hafnium silicate, yttrium silicate, yttria stabilized zirconia, gadolinia stabilized zirconia, calcium aluminosilicates, mullite, and barium strontium aluminosilicate, or combinations thereof.

DETAILED DESCRIPTION

Figure 1:
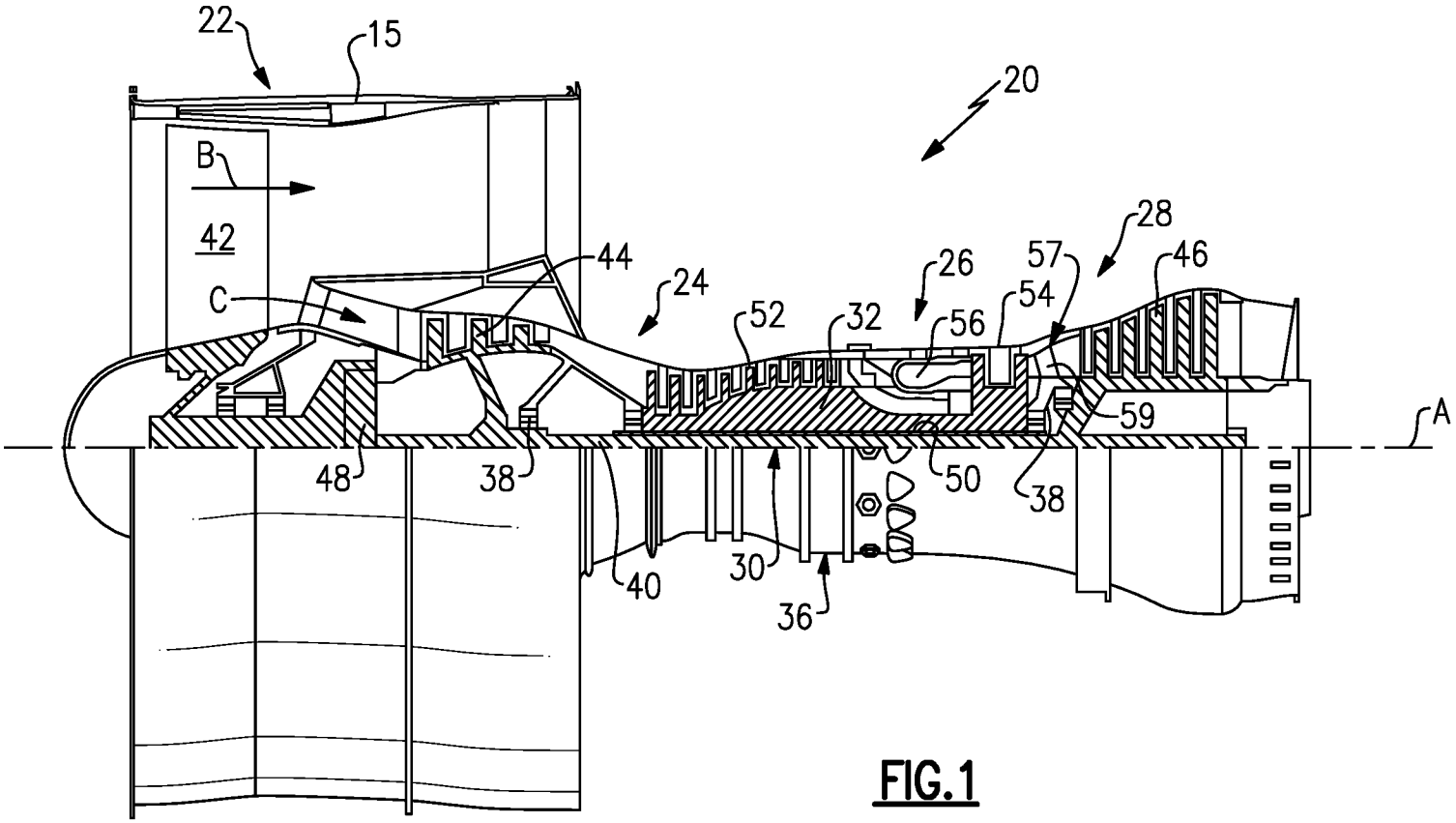
FIG. 1 is a schematic view of an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in the exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), and can be less than or equal to about 18.0, or more narrowly can be less than or equal to 16.0. The geared architecture 48 is an epicyclic gear train, such as a planetary gear system or other gear system, with a gear reduction ratio of greater than about 2.3. The gear reduction ratio may be less than or equal to 4.0. The low pressure turbine 46 has a pressure ratio that is greater than about five. The low pressure turbine pressure ratio can be less than or equal to 13.0, or more narrowly less than or equal to 12.0. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to an inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. The engine parameters described above and those in this paragraph are measured at this condition unless otherwise specified. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45, or more narrowly greater than or equal to 1.25. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150.0 ft/second (350.5 meters/second), and can be greater than or equal to 1000.0 ft/second (304.8 meters/second).

Figure 2:
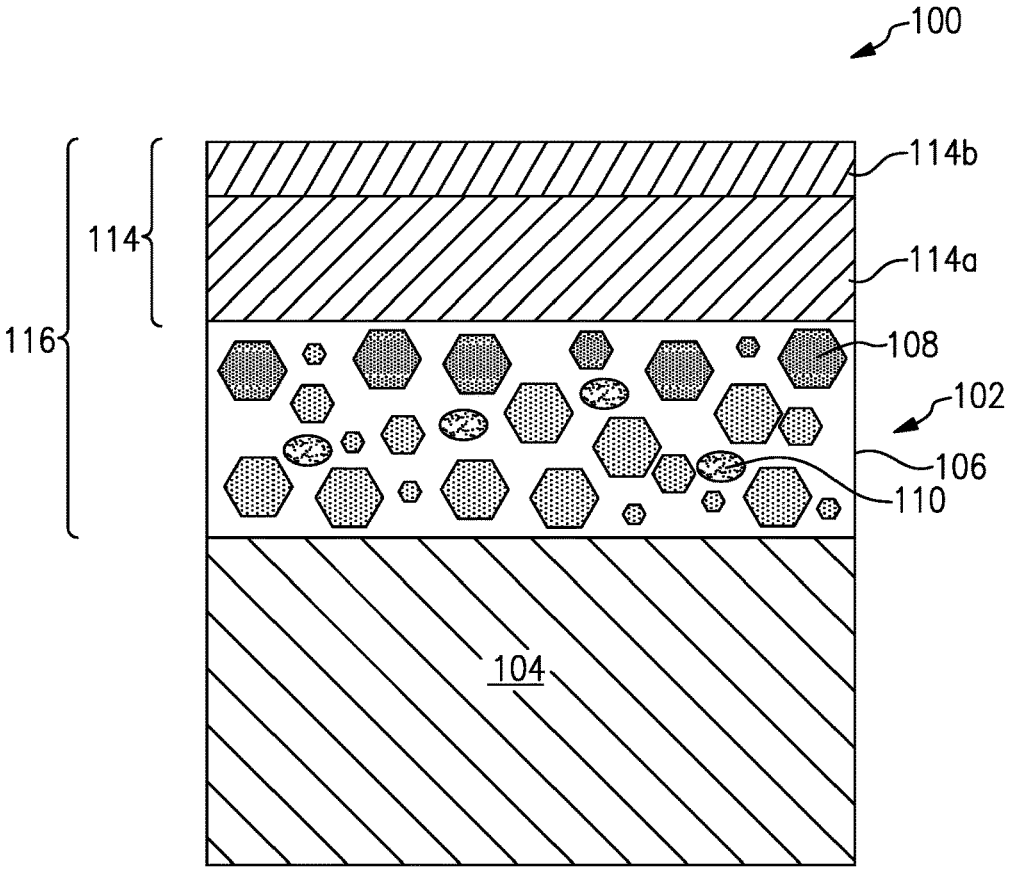
FIG. 2 illustrates an article for the gas turbine engine of claim 1 with a coating.

FIG. 2 schematically illustrates a representative portion of an example article 100 for the gas turbine engine 20 that includes a composite material bond coat 102 that acts as a barrier layer. The article 100 can be, for example, an airfoil in the turbine section 28, a combustor liner panel in the combustor section 26, a blade outer air seal, or other component that would benefit from the examples herein. In this example, the bond coat 102 is used as an environmental barrier layer to protect an underlying substrate 104 from environmental conditions, as well as thermal conditions. As will be appreciated, the bond coat 102 can be used as a stand-alone barrier layer, as an outermost/top coat with additional underlying layers, or in combination with other coating under- or over-layers, such as, but not limited to, ceramic-based topcoats.

The bond coat 102 is generally a silicon-based ceramic coating, such as one comprising silicon carbide, silicon oxide, silicon oxycarbide, or combinations thereof. The bond coat 102 may include a silicon-based matrix with a dispersion of particles in the matrix. In general, the bond coat 102 provides protection to the substrate 104. The bond coat 102 protects the underlying substrate 104 from oxygen and moisture (e.g., provides environmental protection). The bond coat 102 may alternatively or additionally provide mechanical and/or thermal protection to the substrate 104. For example, the substrate 104 can be a ceramic-based substrate, such as a silicon-containing ceramic material. One example is silicon carbide. Another non-limiting example is silicon nitride. Ceramic matrix composite (CMC) substrates 104 such as silicon carbide fibers in a silicon carbide matrix are also contemplated. These CMC substrates can be formed by melt infiltration, chemical vapor infiltration (CVI), polymer infiltration and pyrolysis (PIP), particulate infiltration, or any other known method.

In a particular example, the bond coat 102 includes a matrix 106, a dispersion of "gettering" particles 108, and a dispersion of diffusive particles 110. The matrix 106 may be silicon dioxide ($SiO_2$), in one example. In one example, the gettering particles 108 are silicon oxycarbide particles (SiOC), silicon carbide particles (SiC), or silicide particles such as molybdenum disilicide ($MoSi_2$) particles 108, though other examples are contemplated. The gettering particles 108 could be, for instance, molybdenum disilicide particles, tungsten disilicide particles, vanadium disilicide particles, niobium disilicide particles, silicon oxycarbide particles, silicon carbide (SiC) particles, silicon nitride ($Si_3N_4$) particles, silicon oxycarbonitride (SiOCN) particles, silicon aluminum oxynitride (SiAlON) particles, silicon boron oxycarbonitride (SiBOCN) particles, or combinations thereof. The diffusive particles 110 could be, for instance, barium magnesium alumino-silicate (BMAS) particles, barium strontium aluminum silicate particles, magnesium silicate particles, calcium aluminosilicate particles (CAS), alkaline earth aluminum silicate particles, yttrium aluminum silicate particles, ytterbium aluminum silicate particles, other rare earth metal aluminum silicate particles, or combinations thereof.

The gettering particles 108 and the diffusive particles 110 function as an oxygen and moisture diffusion barrier to limit the exposure of the underlying substrate 104 to oxygen and/or moisture from the surrounding environment. Without being bound by any particular theory, the diffusive particles 110, such as BMAS particles 110, enhance oxidation and moisture protection by diffusing to the outer surface of the barrier layer opposite of the substrate 104 and forming a sealing layer that seals the underlying substrate 104 from oxygen/moisture exposure. Additionally, cationic metal species of the diffusive particles 110 (for instance, for BMAS particles, barium, magnesium, and aluminum) can diffuse into the gettering particles 108 to enhance oxidation stability of the gettering material. Further, the diffusion behavior of the diffusive particles 110 may operate to seal any microcracks that could form in the barrier layer. Sealing the micro-cracks could prevent oxygen from infiltrating the barrier layer, which further enhances the oxidation resistance of the barrier layer. The gettering particles 108 can react with oxidant species, such as oxygen or water that could diffuse into the bond coat 102. In this way, the gettering particles 108 could reduce the likelihood of those oxidant species reaching and oxidizing the substrate 104.

The bond coat 102 can be applied by any known method, such as a slurry coating method similar to the method describe herein.

A ceramic-based top coat 114 is interfaced directly with the bond coat 102. The top coat 114 is discussed in more detail below. The top coat 114 and bond coat 102 together form a barrier coating 116 for the substrate 104.

The top coat 114 includes an oxide-based material. The oxide-based material can be, for instance, hafnium-based oxides or yttrium-based oxides (such as hafnia, hafnium silicates, or yttrium silicates), ytterbium silicates, other rare earth silicates or combinations of rare earth silicates, calcium aluminosilicates, mullite, barium strontium aluminosilicate, strontium aluminosilicate, or combinations thereof, but is not limited to such oxides.

The top coat 114 may be prone to segmentation cracking near its interface with the bond coat 102 due to shrinkage that can result from phase transformations and/or reduction of specific surface area of the top coat 114 that occur during the deposition process and/or post-application sintering processes and/or stresses arising due to mismatch in the coefficient of thermal expansion between the top coat 114 and the substrate 104 and/or the bond coat 102. The propensity for segmentation cracking can be reduced by increasing the compliance of the top coat 114. At the same time, it is desirable for the top coat 114 to be less compliant and smooth at its outermost surface to provide some mechanical protection to the article 100 and contribute to overall aerodynamic efficiency of the article 100 and thus the engine 20.

Accordingly the top coat 114 includes at least two layers **114*a*/114*b*. The first layer 114*a* is adjacent the bond coat 102, and is the innermost layer of the top coat 114. The second layer 114*b* is disposed over the first layer 114*b*, and is the outermost layer of the top coat 114. Both layers 114*a*/114*b* are comprised of oxide-based materials as discussed above. The layers 114*a*/114*b*** can comprise the same of different materials.

The innermost layer **114*a* of the top coat 114 is less dense (more porous) and therefore more compliant than the outermost layer 114*b* of the top coat 114. In a particular example, the innermost layer 114*a* has a porosity between about 10% and about 20%. The increased relative compliance of the innermost layer 114*a* mitigates segmentation cracking by accommodating shrinkage, reduction of specific surface area, and stresses arising from coefficient of thermal expansion differences as discussed above. On the other hand, the outermost layer 114*b* of the top coat 114 is less complaint and denser (less porous) than the innermost layer 114*a* to provide mechanical protection to the article 100 and improve engine 20 efficiency as discussed above. In a particular example, the outermost layer 114*b* has a porosity between about 5% and about 10%. Because the outermost layer 114*b* is as dense or denser than prior art top coats 114, it allows the innermost layer 114*a* to be relatively more compliant than prior art top coats 114 while meeting the requirements of the barrier coating 116**.

Percentage porosity is determined by determining the Archimedes density and x-ray density of freestanding samples of a material, such as the innermost layer **114*a* and the outermost layer 114*b***. Percentage porosity is calculated as (1−(Archimedes density/x-ray density))*100. Determining the Archimedes density and x-day density of material samples is well known in the art.

In some examples, the outermost layer **114*b*** has a surface roughness of less than about 6 microns (150 microinches). In this example, the surface roughness is measured by profilometry.

The innermost layer **114*a* is thicker than the outermost layer 114*b* to maximize its ability to accommodate shrinkage, reduction of specific surface area, and stresses arising from coefficient of thermal expansion differences as discussed above. In some examples, the innermost layer 114*a* is between about 1.5 and about 2.5 times the thickness of the outermost layer 114*b*. In a particular example, the innermost layer 114***a* is between about 50 and about 250 microns thick while the outermost layer 114*b* is between about 25 and about 125 microns thick.

Though in the example of FIG. 2 the topcoat 114 is the outermost layer of the barrier coating 116, and is exposed to the elements when the article 100 is in use, in other examples, additional layers could be disposed over the top coat 114. For instance, an abradable outer layer can be disposed on the top coat 114.

Figure 3:
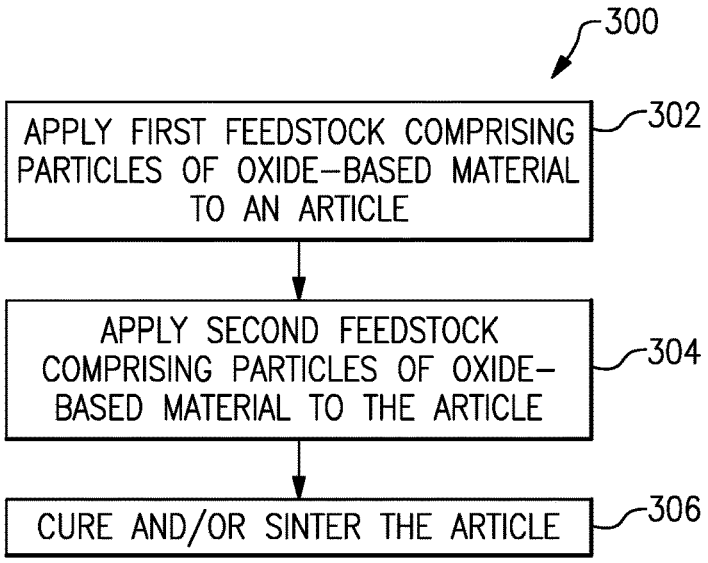
FIG. 3 schematically illustrates a method of applying the coating of FIG. 2.

FIG. 3 schematically illustrates a method 300 of applying the top coat 114 by a deposition process such as air plasma spray, suspension deposition processes, electrophoretic deposition (EPD), or another process. In step 302, a first feedstock comprising particles of oxide-based material is applied to an article 100 having a bond coat 102 by a by a deposition process such as air plasma spray, suspension deposition processes, electrophoretic deposition (EPD), or another process. Application of a particulate feedstock by various deposition processes are well known in the art and will not be described here. The first feedstock comprises particles ranging between about 1 micron and about 80 microns in diameter. In a particular example, the first feedstock comprises particles ranging between about 10 and about 70 microns in diameter.

In step 304, a second feedstock comprising particles of oxide-based material is applied to the article 100 by a by a deposition process such as air plasma spray, suspension deposition processes, electrophoretic deposition (EPD), or another process. The process can be the same or different process as is used in step 302. The second feedstock comprises particles ranging between about 15 micron and about 60 microns in diameter. In a particular example, the second feedstock comprises particles ranging between about 20 and about 50 microns in diameter. In one example, step 304 is performed immediately after step 302 and without moving or disturbing the article 100. This saves time and expense and minimizes risk of damages or introducing imperfections into the article 100 from handling it.

In a particular example where the deposition process is air plasma spray, the air plasma spray apparatus may include multiple ports as is well known in the art. The first feedstock may be delivered via a first port and the second feedstock may be delivered by a second port. During step 302, the air plasma spray apparatus provides the first feedstock via the first portion and the air plasma spray apparatus may be configured to switch to the second port for step 304, without moving or disturbing the article 100. In some particular examples, the same programming may be used to direct the air plasma spray apparatus during steps 302 and 304.

The larger particles in the first feedstock compared to the second feedstock cause the formation of the less dense (more porous) and more compliant innermost layer 114*a* and more dense (less porous) and less compliant outermost layer 114*b*.

In step 306, the top coat 114 (including both layers 114*a*/114*b*) is cured and/or sintered at a temperature suitable for sintering the materials selected for the top coat 114.

As used herein, the term "about" has the typical meaning in the art, however in a particular example "about" can mean deviations of up to 10% of the values described herein.

Although the different examples are illustrated as having specific components, the examples of this disclosure are not limited to those particular combinations. It is possible to use some of the components or features from any of the embodiments in combination with features or components from any of the other embodiments.

The foregoing description shall be interpreted as illustrative and not in any limiting sense. A worker of ordinary skill in the art would understand that certain modifications could come within the scope of this disclosure. For these reasons, the following claims should be studied to determine the true scope and content of this disclosure.

What is claimed is:

1. A method of applying a top coat to an article comprising:

applying a first feedstock comprising particles of oxide-based material having diameters between about 1 and about 80 microns via a thermal spray process to form a first top coat layer on an article having a bond coat; and applying a second feedstock comprising particles of oxide-based material having diameters between about 15 and about 60 microns via the thermal spray process to form a second top coat layer on the first top coat layer, wherein the first top coat layer has a higher porosity than the second top coat layer.

2. The method of claim 1, wherein the particles of oxide-based material include particles of at least one of hafnia, hafnium silicates, yttrium silicates, ytterbium silicates, other rare earth silicates or combinations of rare earth silicates, calcium aluminosilicates, mullite, barium strontium aluminosilicate, strontium aluminosilicate.

3. The method of claim 1, wherein the thermal spray process is one of air plasma spray, a suspension deposition process, and electrophoretic deposition (EPD).

4. The method of claim 1, wherein the second top coat layer is performed without moving the article after the step of applying the first top coat layer.

5. The method of claim 1, further comprising curing or sintering the first and second top coat layers.

6. The method of claim 1, wherein a surface roughness of the second top coat layer is less than about 6 microns (150 microinches).

7. The method of claim 1, wherein the particles in the first feedstock have diameters between about 10 and about 70 microns.

8. The method of claim 1, wherein the particles in the second feedstock have diameters between about 20 and about 50 microns.

9. The method of claim 1, wherein the particles of oxide-based material include particles of hafnium silicates.

10. The method of claim 1, wherein the particles of oxide-based material include particles of yttrium silicates.

11. The method of claim 1, wherein the particles of oxide-based material include particles of ytterbium silicates.

12. The method of claim 1, wherein the particles of oxide-based material include particles of calcium aluminosilicates.

13. The method of claim 1, wherein the particles of oxide-based material include particles of strontium aluminosilicate.

14. The method of claim 1, wherein the first top coat layer is between about 1.5 and 2.5 times the thickness of the second top coat layer.

* * * * *